US009171712B2

(12) United States Patent
Curry et al.

(10) Patent No.: US 9,171,712 B2
(45) Date of Patent: Oct. 27, 2015

(54) LAMP HAVING A SECONDARY HALIDE THAT IMPROVES LUMINOUS EFFICIENCY

(71) Applicant: NATIONAL INSTITUTE OF STANDARDS AND TECHNOLOGY, Gaithersbrug, MD (US)

(72) Inventors: John J Curry, Frederick, MD (US); Walter P Lapatovich, Boxford, MA (US); Edgar G Estupinan, Peabody, MA (US)

(73) Assignee: NATIONAL INSTITUTE OF STANDARDS AND TECHNOLOGY, Washington, DC (US)

( * ) Notice: Subject to any disclaimer, the term of this patent is extended or adjusted under 35 U.S.C. 154(b) by 0 days.

(21) Appl. No.: 14/324,156

(22) Filed: Jul. 5, 2014

(65) Prior Publication Data

US 2014/0320003 A1 Oct. 30, 2014

(51) Int. Cl.

| | |
|---|---|
| ***H01J 61/18*** | (2006.01) |
| ***H01J 61/12*** | (2006.01) |
| ***H01J 61/82*** | (2006.01) |

(52) U.S. Cl.

CPC ..... *H01J 61/18* (2013.01); *H01J 61/125* (2013.01); *H01J 61/827* (2013.01)

(58) Field of Classification Search

CPC ..... H01J 61/125; H01J 61/827; H01J 61/26; C08F 26/02

See application file for complete search history.

(56) References Cited

U.S. PATENT DOCUMENTS

| | | | | |
|---|---|---|---|---|
| 3,405,303 | A | 10/1968 | Koury | |
| 3,521,110 | A | 7/1970 | Johnson | |
| 3,654,506 | A | 4/1972 | Kuhl | |
| 3,761,458 | A | 9/1973 | Bamberg | |
| 4,171,498 | A | 10/1979 | Fromm | |
| 5,013,968 | A | 5/1991 | Russell | |
| 7,141,932 | B2 * | 11/2006 | Deguchi et al. | 313/638 |
| 8,410,698 | B2 * | 4/2013 | Haacke et al. | 313/637 |
| 8,427,052 | B2 | 4/2013 | Van Der Burgt | |
| 2009/0302784 | A1 * | 12/2009 | Franke et al. | 315/307 |
| 2011/0133638 | A1 | 6/2011 | Van Der Burgt | |
| 2011/0204776 | A1 * | 8/2011 | Genz | 313/641 |

FOREIGN PATENT DOCUMENTS

EP 1134776 A2 9/2001

OTHER PUBLICATIONS

Curry et al, Enhancement of Lanthanide Evaporation by Complexation: Dysprosium Tri-Iodide Mixed with Indium Iodide and Thulium Tri-Iodide Mixed with Thallium Iodide, The Journal of Chemical Physics,139-124310, (2013).

Curry et al, Observation of Vapor Pressure Enhancement of Rare-Earth Metal-Halide Salts in the Temperature Range Relevant to Metal-Halide Lamps, Applied Physics Letters,100-083505 (2012).

Curry et al, Measurement of Vapor Pressures Using X-Ray Induced Fluorescence, Chemical Physics Letters, 507 (2011) 52-56.

* cited by examiner

*Primary Examiner* — Tracie Y Green
(74) *Attorney, Agent, or Firm* — Toby D. Hain

(57) ABSTRACT

A lamp to produce white light includes an envelope; and a composition disposed in the envelope and including an initiator; a primary halide; and a secondary halide, wherein the primary halide, in a presence of the secondary halide, has a vapor pressure that is greater than a vapor pressure in an absence of the secondary halide, and the composition is configured to emit white light in a presence of an electrical discharge in the envelope.

20 Claims, 3 Drawing Sheets

LAMP HAVING A SECONDARY HALIDE THAT IMPROVES LUMINOUS EFFICIENCY

STATEMENT REGARDING FEDERALLY SPONSORED RESEARCH

This invention was made with United States government support from the National Institute of Standards and Technology. The government has certain rights in the invention.

BACKGROUND

Gas discharge lamps are used in commercial, industrial, and consumer environments. Some gas discharge lamps suffer from an undesired lumen or color output during an extended initial period until the lamp is sufficiently hot to vaporize certain compounds.

Accordingly, advances in articles and processes for lighting would be advantageous and received favorably in the art.

BRIEF DESCRIPTION

The above and other deficiencies are overcome by, in an embodiment, a lamp comprising: an envelope; and a composition disposed in the envelope and comprising: an initiator; a primary halide; and a secondary halide, wherein the primary halide, in a presence of the secondary halide, has a vapor pressure that is greater than a vapor pressure in an absence of the secondary halide, and the composition is configured to emit white light in a presence of an electrical discharge in the envelope.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments is presented herein by way of exemplification and not limitation.

It has been found that a lamp herein exhibits superior lumen output and color during a warm up period as well as during operation. Accordingly, the lamp is applicable to numerous uses for efficient production of stable white light. Advantageously, the lamp includes a rare earth element that has an increased vapor pressure in a presence of a secondary halide, such as $GaI_3$, InI, TlI, or the like. This effect is particularly dominant at a temperature achieved during the warm up period.

Figure 1:
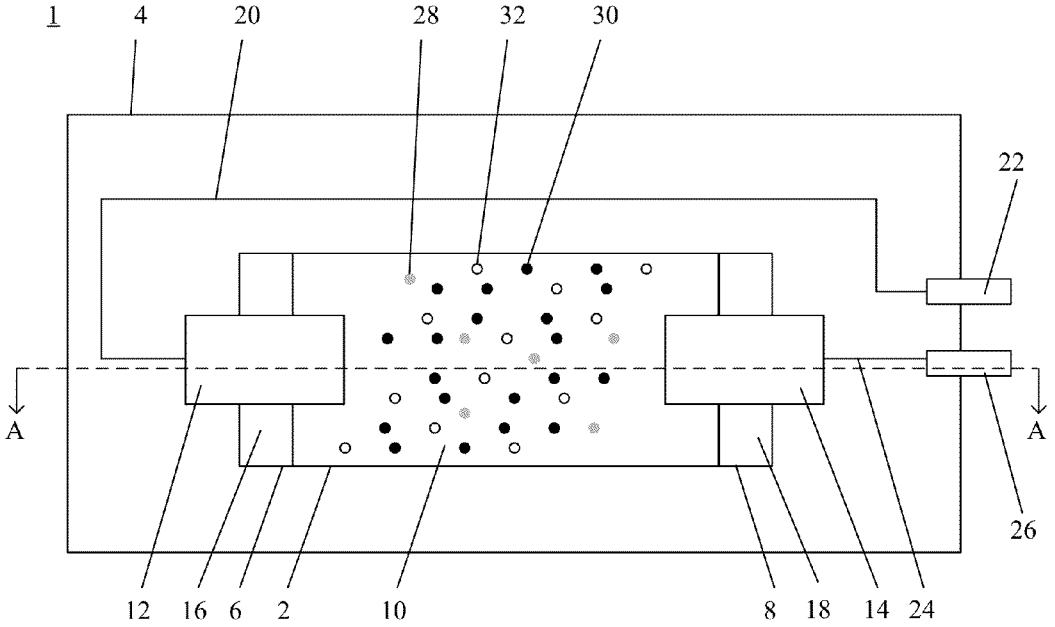
FIG. 1 shows a first cross-section of a lamp.
Figure 2:
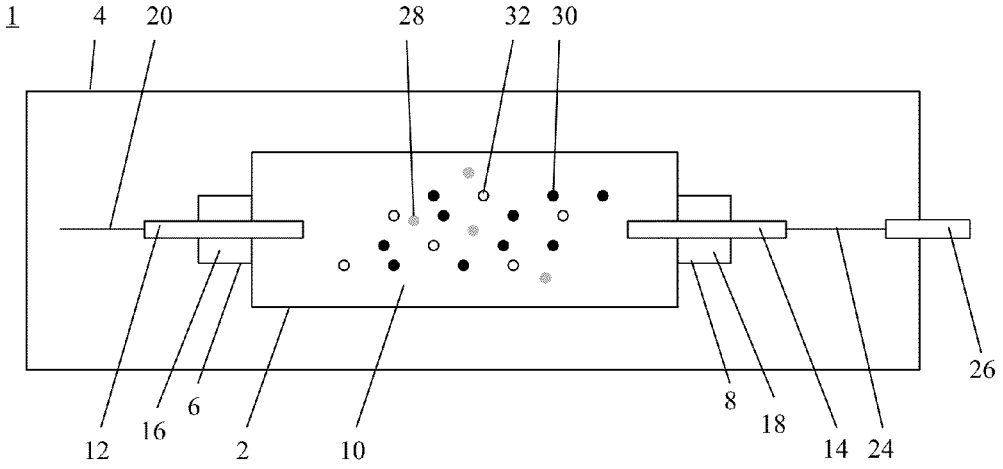
FIG. 2 shows a second cross-section of the lamp shown in FIG. 1.

With reference to FIG. 1, which shows a cross-section of lamp 1, and FIG. 2, which shows a cross-section of lamp 1 along line A-A in FIG. 1, in an embodiment, lamp 1 includes envelope 2 disposed in container 4. Envelope 2 is sealed at first end 6 and second end 8 to avoid loss of composition 10 disposed therein. First end 6 and second end 8 respectively include first seal 16 and second seal 18 that respectively seal around first electrode 12 and second electrode 14 that extend from an interior of envelope 2 into container 4. Wire 20 electrically connects first electrode 12 to third electrode 22, and wire 24 electrically connects second electrode 14 to fourth electrode 26. Container 4 is sealed such that a fluid (e.g., a gas or liquid) is not communicated across container 4. Third electrode 22 and fourth electrode 26 traverse container 4 to electrically connect first electrode 12 and second electrode 14 to a power source. In this manner, first electrode 12 and second electrode 14 are configured to be electrically biased such that an electrical discharge occurs in envelope 2 through composition 10.

According to an embodiment, lamp 1 includes composition 10 disposed in envelope 10. Here, lamp 1 operates in absence of an electrode such that lamp 1 is an electrodeless lamp that is configured to excite constituents in composition 10 with power from an external source such as a radio frequency.

Composition 10 includes initiator 28, primary halide 30, and secondary halide 32. In a presence of the electrical discharge in envelope 2, composition 10 is configured to emit light, particularly white light. The electrical discharge heats composition 10. As a result, a vapor pressure of primary halide 30 and secondary halide 32 increase. Further, primary halide 30 in a presence of secondary halide 32 has a vapor pressure that is greater than a vapor pressure in an absence of secondary halide 32. Hence, secondary halide 32 enhances the vapor pressure of primary halide 30 such that, during a warm up period of lamp 1 (that occurs before entering an operation period), light emitted by composition 10 achieves a white light spectrum faster than lamp 1 in an absence of secondary halide 32 or where an amount of secondary halide 32 is too small to achieve the white light spectrum.

In an embodiment, a buffer gas is disposed in envelope 2 as part of composition 10. In some embodiments, container 4 is evacuated to a pressure less than that of a surrounding environment in which lamp 1 is disposed. In certain embodiment, a gas is included in container 4 external to envelope 2.

In an embodiment, envelope 2 is selected to transmit the white light produced by composition 10. According to an embodiment, envelope 2 filters a wavelength of light produced by composition 10, e.g., an ultraviolet or infrared wavelength, and transmits a visible wavelength of light. Envelope 2 includes a ceramic, a glass, or a combination thereof.

The glass can be a silicon oxide-containing material in a solid, amorphous state without crystallization or with some amount of crystallinity, e.g., having a crystalline domain. Glass that is amorphous has a high degree of microstructural disorder due to a lack of long-range order. The glass can include an oxide, for example, silicon dioxide ($SiO_2$), aluminum oxide ($Al_2O_3$), barium oxide (BaO), bismuth trioxide ($Bi_2O_3$), boron oxide ($B_2O_3$), calcium oxide (CaO), cesium oxide (CsO), lead oxide (PbO), strontium oxide (SrO), rare earth oxides (e.g., lanthanum oxide ($La_2O_3$), neodymium oxide ($Nd_2O_3$), samarium oxide ($Sm_2O_3$), cerium oxide ($CeO_2$)), and the like.

An exemplary glass is $SiO_2$ (e.g., quartz, cristobalite, tridymite, and the like). The glass can include $SiO_2$ and other components such as an element, e.g., aluminum, antimony, arsenic, barium, beryllium, boron, calcium, cerium, cesium, chromium, cobalt, copper, gallium, gold, iron, lanthanum, lead, lithium, magnesium, manganese, molybdenum, neodymium, nickel, niobium, palladium, phosphorus, platinum, potassium, praseodymium, silver, sodium, tantalum, thorium, titanium, vanadium, zinc, zirconium, and the like. The element can occur in the glass in the form of an oxide, carbonate, nitrate, phosphate, sulfate, or halide. Furthermore, the element can be a dopant in the glass. Exemplary doped glass includes borosilicate, borophosphosilicate, phosphosilicate, colored glass, milk glass, lead glass, optical glass, fused silica, and the like.

In an embodiment, the glass can include a non-amorphous, crystalline domain. Such glass can be, e.g., a salt or ester of orthosilicic acid or a condensation product thereof, e.g., a silicate. Exemplary silicates are cyclosilicates, inosilicates, mesosilicates, orthosilicates, phyllosilicates, sorosilicates, tectosilicates, and the like. These glasses have a structure based on silicon dioxide or isolated or linked $[SiO_4]^{4-}$ tetrahedral and include other components such as, e.g., aluminum, barium, beryllium, calcium, cerium, iron, lithium, magnesium, manganese, oxygen, potassium, scandium, sodium, titanium, yttrium, zirconium, zinc, hydroxyl groups, halides, and the like.

The ceramic is not particularly limited and can be selected depending on a particular application of lamp 1. Examples of the ceramic include an oxide-based ceramic, nitride-based ceramic, carbide-based ceramic, boride-based ceramic, silicide-based ceramic, or a combination thereof. In an embodiment, the oxide-based ceramic is silica ($SiO_2$) or titania ($TiO_2$). The oxide-based ceramic, nitride-based ceramic, carbide-based ceramic, boride-based ceramic, or silicide-based ceramic can contain a nonmetal (e.g., oxygen, nitrogen, boron, carbon, or silicon, and the like), metal (e.g., aluminum, lead, bismuth, and the like), transition metal (e.g., niobium, tungsten, titanium, zirconium, hathium, yttrium, and the like), alkali metal (e.g., lithium, potassium, and the like), alkaline earth metal (e.g., calcium, magnesium, strontium, and the like), rare earth (e.g., lanthanum, cerium, and the like), halogen (e.g., fluorine, chlorine, and the like), and the like.

Exemplary ceramics include a sintered ceramic such as polycrystalline alumina, dysprosia, yttria, aluminum nitride, crystalline sapphire, and the like.

Envelope 2 is disposed in container 4. Container 4 can be a ceramic, glass, or combination thereof as recited above for envelope 2. In an embodiment, container 4 is a same material as envelope 2. In a particular embodiment, container 4 is a different material than envelope 2.

First seal 16 and second seal 18 are a ceramic or glass that are a same or different material than envelope 2. In one embodiment, envelope 2, first seal 16, and second seal 18 are an integrated member having a monolithic structure. In another embodiment, are separate members that are joined into a single item that seals composition 10 therein. Here, first seal 16 and second seal 18 can be joined to envelope 2 chemically or physically by, e.g., press fitting, adhesion (e.g., using an adhesive such as epoxy or other compatible polymer), and the like. First seal 16 and second seal 18 can be sealingly formed around first electrode 12 and second electrode 14 mechanically (e.g., by crimping, melting, pinching) or chemically (e.g., bonding, alloying, adhering). According to an embodiment, an interstitial material (not shown) is interposed between first seal 16 and first electrode 12 to form the seal therebetween. Similarly, an interstitial material (not shown) can be interposed between second seal 18 and second electrode 14 to form the seal therebetween. The interstitial material can be, e.g., a metal such as a foil of molybdenum, tantalum, and the like.

In an embodiment, seals between container 4 and third electrode 22 and fourth electrode 26 are made similar to those for first electrode 12 and second electrode 14 with envelope 2.

Composition 10 disposed in envelope 2 includes initiator 28, primary halide 30, secondary halide 32, and buffer gas. Initiator 28, primary halide 30, secondary halide 32 independently can be a gas, liquid, solid, or a combination thereof, depending on an environment inside envelope 2. According to an embodiment, initiator 28 includes a material that absorbs energy from the electrical discharge. Exemplary initiators includes mercury, xenon, zinc, and the like. Such initiators can be included in composition 10 in a stable form such as $ZnI_2$, liquid mercury, and the like that enter a gas phase in response to formation of the electrical discharge in envelope 2. It is contemplated that initiator 28 does not produce white light, but that due to a presence of primary halide 30, composition 10 produces white light in response to the electrical discharge.

Primary halide 30 includes a salt of a halide (e.g., fluoride, chloride, bromide, iodide, and the like) with a rare earth element, a transition metal, an alkali metal, an alkaline earth metal, a group 13 element, a group 14 element, a group 15 element, a group 16 element or a combination thereof and a group 17 elements as the halide. In an embodiment, primary halide 30 is a rare earth halide, an alkali metal halide, an alkaline earth metal halide, and the like. Rare earth elements include a scandium, yttrium, a lanthanide element, an actinide element, and the like. Exemplary rare earth elements include La, Ce, Dy, Ho, and Tm. Exemplary rare earth halides include $LaF_3$, $LaCl_3$, $LaBr_3$, $LaI_3$, $LaI_2$, $CeF_4$, $CeF_3$, $CeCl_3$, $CeBr_3$, $CeI_3$, $CeI_2$, $PrF_4$, $PrF_3$, $PrCl_3$, $PrCl_2$, $PrBr_3$, $PrI_3$, $PrI_2$, $NdF_4$, $NdF_3$, $NdCl_3$, $NdCl_2$, $NdBr_3$, $NdI_3$, $NdI_2$, $SmF_3$, $SmF_2$, $SmCl_3$, $SmCl_2$, $SmBr_3$, $SmBr_2$, $SmI_3$, $SmI_2$, $EuF_3$, $EuF_2$, $EuCl_3$, $EuCl_2$, $EuBr_3$, $EuBr_2$, $EuI_3$, $EuI_2$, $GdF_3$, $GdCl_3$, $GdBr_3$, $GdI_3$, $GdI_2$, $TbF_4$, $TbF_3$, $TbCl_3$, $TbBr_3$, $TbI_3$, $DyF_3$, $DyCl_3$, $DyBr_3$, $DyI_3$, $HoF_3$, $HoCl_3$, $HoBr_3$, $HoI_3$, $ErF_3$, $ErCl_3$, $ErCl_2$, $ErBr_3$, $ErI_3$, $TmF_3$, $TmCl_3$, $TmBr_3$, $TmI_3$, $TmI_2$, $YbF_3$, $YbF_2$, $YbCl_3$, $YbCl_2$, $YbBr_3$, $YbBr_2$, $YbI_3$, $YbI_2$, $LuF_3$, $LuCl_3$, $LuBr_3$, $LuI_3$, and the like.

Exemplary transition metal halides include a halide of a transition metal such as Sc, Y, Zn, Fe, Cu, Cr, and the like. Exemplary alkali metal halides include a halide of an alkali metal such as Cs, Na, K, and the like. Exemplary alkaline earth metal halides include a halide of an alkaline earth metal such as Ca, Ba, Sr, Mg, and the like.

In an embodiment, the primary halide is a rare earth halide including $DyI_3$, $HoI_3$, $CeI_3$, $TmI_3$, $Dy_2I_6$, or a combination thereof. It is contemplated that in addition to the rare earth halide, the primary halide includes a halide salt that has a relatively high vapor pressure such as the alkali metal halide, alkaline earth metal halide, or a combination thereof.

In an embodiment, composition 10 further includes a resonant radiator (which may also be referred to as an arc fattener) such as cesium iodide, thallium iodide, indium iodide, and the like.

Composition 10 also includes secondary halide 32. According to an embodiment, secondary halide 32 includes a first element and a second element. The first element is a group 13 element (e.g., In, Ga, Tl, and the like), a group 14 element (e.g., Si, Ge, Sn, Pb, and the like), a group 15 element (e.g., P, As, Sb, and the like), a group 16 element (e.g., O, S, Se, Te, and the like), or a combination thereof. The second element includes a group 17 element such as F, Cl, Br, I, and the like in a form, e.g., of a halide. It is contemplated that second halide 32 has a vapor pressure greater than that of primary halide 30.

According to an embodiment, during a warm up period or operation period of lamp 1, inclusion of secondary halide 32 in composition 10 with primary halide 30 increases a vapor pressure of primary halide 30. In some embodiments, a reaction product that includes primary halide 30 and secondary halide 32 is formed in presence of the electrical discharge in envelope 2. Without wishing to be bound by theory, it is believed that secondary halide 32 and primary halide 30 form a complex that promotes or enhances a number density of primary halide 30 in a gas phase.

In a particular embodiment, composition 10 includes a buffer gas (e.g., Ar), and initiator 28 is mercury; primary halide 30 includes a rare earth metal halide, and secondary halide 32 includes $GaI_3$, InI, or a combination thereof. In some embodiments, composition 10 includes Ar, Hg, NaI, CeI3, TlI, CaI2, and GaI3. In other embodiments, composition 10 includes InI, GaI3, or a combination thereof; Ar; Hg; NaI; a plurality of rare earth halides (e.g., $HoI_3$, $TmI_3$, and $DyI_3$); TlI; and $CaI_2$.

The primary halide can be present in an amount from 1 weight percent (wt %) to 30 wt %, specifically from 2 wt % to 20 wt %, and more specifically from 2 wt % to 15 wt %, based on a weight of the composition. The secondary halide can be present in an amount from 0.1 wt % to 10 wt %, specifically from 0.1 wt % to 5 wt %, and more specifically from 0.2 wt % to 1 wt %, based on a weight of the composition.

According to an embodiment, the primary halide includes a rare earth element, and the secondary halide includes a group 13 element such that the rare earth element of the primary halide and the group 13 element of the secondary halide are present in a molar ratio from 0.5:1 to 30:1, specifically from 1:1 to 25:1, and more specifically from 2:1 to 20:1.

The buffer gas can be present in an amount from 1 torr to 5000 torr, specifically from 50 torr to 800 torr, and more specifically from 100 torr to 400 torr.

In an embodiment, the composition includes from 19 $mg/cm^3$ to 27 $mg/cm^3$ metallic mercury, from 7.5 $mg/cm^3$ to 10 $mg/cm^3$ NaI, from 1.1 $mg/cm^3$ to 1.6 $mg/cm^3$ $CeI_3$, from 1.4 $mg/cm^3$ to 2 $mg/cm^3$ TlI, from 2 $mg/cm^3$ to 2.8 $mg/cm^3$ $CaI_2$, and from 0.10 $mg/cm^3$ to 0.14 $mg/cm^3$ $GaI_3$.

According to an embodiment, the composition includes from 19 $mg/cm^3$ to 27 $mg/cm^3$ metallic mercury, from 7.5 $mg/cm^3$ to 10 $mg/cm^3$ NaI, from 1.2 $mg/cm^3$ to 1.7 $mg/cm^3$ each of $HoI_3$, $TmI_3$ and DyI3; from 1.4 $mg/cm^3$ to 2 $mg/cm^3$ TlI; from 2 $mg/cm^3$ to 2.8 $mg/cm^3$ $CaI_2$, and from 0.15 $mg/cm^3$ to 0.25 $mg/cm^3$ InI.

In a certain embodiment, the composition includes from 19 $mg/cm^3$ to 27 $mg/cm^3$ metallic mercury, from 7.5 $mg/cm^3$ to 10 $mg/cm^3$ NaI, from 1.2 $mg/cm^3$ to 1.7 $mg/cm^3$ each of $HoI_3$, $TmI_3$ and $DyI_3$; from 1.4 $mg/cm^3$ to 2 $mg/cm^3$ TlI; from 2 $mg/cm^3$ to 2.8 $mg/cm^3$ $CaI_2$, and from 0.30 $mg/cm^3$ to 0.42 $mg/cm^3$ $GaI_3$.

It should be appreciated that these amounts of the primary halide, secondary halide, buffer gas, and the like are adjustable based on a desired power of light emitted from the lamp. In an embodiment, the secondary halide is present in the composition in an amount from 0.001 $mg/cm^3$ to 2.99 $mg/cm^3$.

The lamp can be produced in numerous ways. In an embodiment, the composition is disposed in the envelope under an inert atmosphere substantially in an absence of water. First and second electrodes are disposed in the envelope, and the envelope is sealed. Third and fourth electrodes are electrically connected to the first and second electrodes, and the envelope is disposed in the container. The container is evacuated or filled with a gas and sealed to produce the lamp.

The lamp has numerous beneficial advantages that includes superior lumen output and light color during a warm up period and operating period of the lamp. The lamp has broad applicability as a light source such as an energy efficient metal halide lamp. Beneficially, the lamp includes a high vapor pressure secondary halide (e.g., $GaI_3$, InI, TlI, and the like), which increases the vapor pressure of the primary halide that emits light. This effect is particularly effective at temperatures achieved during the warm up period. Additionally, the lamp produces pleasing white light with a minimal warm up period upon initiation of the electric discharge in the envelope.

As used herein, the warm up period of the lamp corresponds to a temperature lower than a steady state temperature and light output of the lamp. Similarly, the operating period of the lamp corresponds to a temperature that is a steady state temperature with substantially constant light output of the lamp. The lamp has a warm up period less than or equal to 5 minutes, specifically less than or equal to 1 minute, more specifically less than or equal to 30 seconds, yet more specifically less than or equal to 20 seconds, and even more specifically less than or equal to 10 seconds, and further more specifically from 1 second to 30 seconds.

The operating period of the lamp begins after the warm up period. It is contemplated that the time after the electrical discharge commences in the envelope of the lamp until the operating period begins is less than or equal to 5 minutes, specifically less than or equal to 1 minute, more specifically less than or equal to 30 seconds, yet more specifically less than or equal to 20 seconds, and even more specifically less than or equal to 10 seconds, and further more specifically from 1 second to 30 seconds.

During the warm up period, the coldest spot in the envelope has a temperature from 450 Kelvin (K) to 1600 K, specifically from 500 K to 1500 K, and more specifically from 500 K to 1400 K. During the operating period, the lamp has a temperature greater than or equal to 1000 K, specifically greater than or equal to 1200 K, more specifically greater than or equal to 1400 K, yet more specifically from 1000 K to 2000 K, and even more specifically from 1400 K to 1700 K.

From the initiation of the electric discharge, the light produced by the lamp changes rapidly to white light. During the warm up period of the lamp, light emitted by the lamp has a plurality of color coordinates that includes x from 0.1 to 0.4; y from 0.1 to 0.4; and z from 0.3 to 0.7, wherein $x+y+z=1$; x is a red color coordinate; y is a green color coordinate; and z is a blue color coordinate, based on an International Commission on Illumination (CIE) 1931 XYZ color space.

In an embodiment, during the operation period of the lamp, light emitted by the lamp has a plurality of color coordinates that includes x from 0.3 to 0.5; y from 0.3 to 0.5; and z from 0.0.2 to 0.4, wherein $x+y+z=1$; x is a red color coordinate; y is a green color coordinate; and z is a blue color coordinate, based on an International Commission on Illumination (CIE) 1931 XYZ color space.

According to an embodiment, to efficiently transmit the white light and filter non-white light wavelengths, the envelope or the container has a transmittance of the white light from 0.5 to 0.999, specifically 0.85 to 0.99, and more specifically from 0.9 to 0.99.

Without wishing to be bound by theory, it is believed that the white light of the lamp is produced in part by the primary halide in the presence of the secondary halide. To increase an amount of white light produced by the composition, the vapor pressure of the primary halide is increased by addition of the secondary halide. Here, the vapor pressure of the primary halide, in the presence of the secondary halide, is, e.g., from 1.1 times to 500 times greater than the vapor pressure of the primary halide in the absence of the secondary halide, more specifically 1.5 times to 250 times greater, yet more specifically 1.5 times to 100 times greater, and even more specifically 1.5 times to 50 times greater.

The white light produced by the composition and emitted from the lamp has a wavelength from 400 nm to 1100 nm, specifically 450 nm to 800 nm, and more specifically from 450 nm to 750 nm. The lamp has an optical power from 0 watts (W) to 3000 W, specifically from 0 W to 1000 W, more specifically 0 W to 300 W, yet more specifically greater than or equal to 50 W, based on an optical power of the white light.

The lamp has a scalable size, and a volume or linear dimension of the lamp can be changed to accommodate different applications, e.g., stadium lighting, warehouse lighting, operating room lighting, residential lighting, and the like. Although there is no particular limit to the size of the lamp, in an embodiment, that lamp has a volume from 0.1 cm3 to 100 $cm^3$, specifically from 0.1 $cm^3$ to 10 $cm^3$, and more specifically from 0.1 $cm^3$ to 0.5 $cm^3$.

The lamp can be used to produce white light by applying power in the form of the electrical discharge in the envelope. In an embodiment, the lamp is used a lighting source in stadium lighting, warehouse lighting, operating room lighting, residential lighting, automotive lighting, and the like.

The lamp and process herein are further illustrated by the following examples, which are non-limiting.

EXAMPLES

Example 1

First Composition

A first composition to produce white light in a lamp includes 23.5 mg/$cm^3$ metallic mercury, 8.85 mg/$cm^3$ NaI, 1.38 mg/$cm^3$ $CeI_3$, 1.74 mg/$cm^3$ TlI, 2.44 mg/$cm^3$ $CaI_2$, 0.119 mg/$cm^3$ $GaI_3$.

Example 2

Second Composition

A second composition to produce white light in a lamp includes 23.5 mg/$cm^3$ metallic mercury; 8.85 mg/$cm^3$ NaI; 1.44 mg/$cm^3$ each of $HoI_3$, $TmI_3$, and $DyI_3$; 1.74 mg/$cm^3$ TlI; 2.44 mg/$cm^3$ $CaI_2$; and 0.191 mg/$cm^3$ InI.

Example 3

Third Composition

A third composition to produce white light in a lamp includes 23.5 mg/$cm^3$ metallic mercury; 8.85 mg/$cm^3$ NaI; 1.44 mg/$cm^3$ each of $HoI_3$, $TmI_3$, and $DyI_3$; 1.74 mg/$cm^3$ TlI; 2.44 mg/$cm^3$ $CaI_2$; and 0.365 mg/$cm^3$ $GaI_3$.

With regard to Examples 1, 2, and 3, it should be appreciated that these quantities can be adjusted based on a selected power level of the white light from the lamp.

Example 4

$DyI_3$ Vapor Pressure Enhancement

Figure 3:
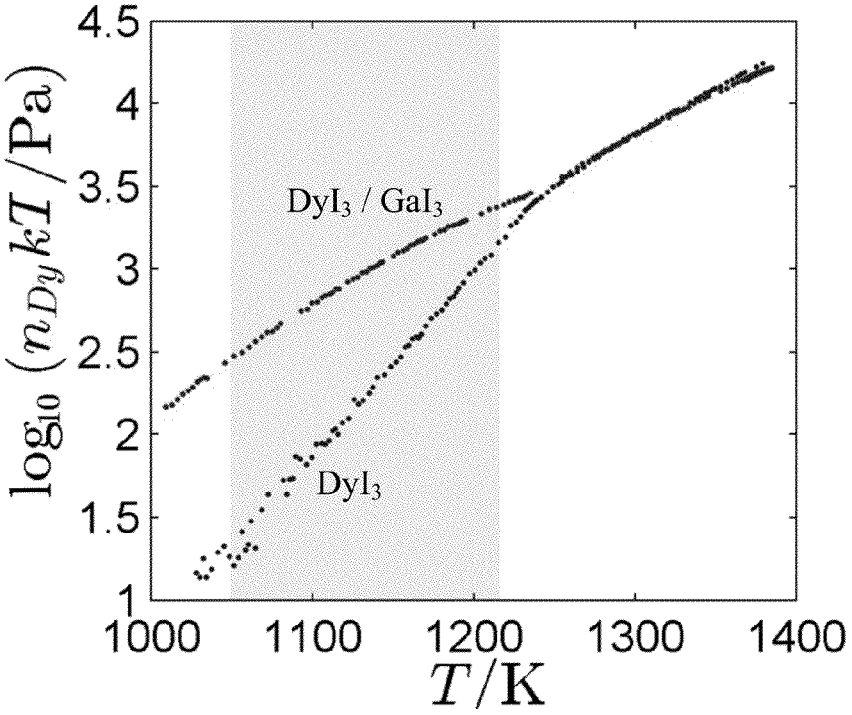
FIG. 3 shows a graph of a logarithm of vapor pressure versus temperature for an embodiment of a composition according to Example 4.

Vapor pressure of two samples were determined using X-ray fluorescence as discussed in Curry et al., J. Chem. Phys. 139, 124310 (2013), the disclosure of which is incorporated herein in its entirety. The first sample included $DyI_3$ and Ar, and the second sample included $DyI_3$, InI, and Ar. FIG. 3 shows a graph of the logarithm of the vapor pressure versus temperature for the first sample (lower curve) and the second sample (upper curve). The InI enhanced the vapor pressure of the $DyI_3$ from the lowest temperatures at least up to 1250 K.

Example 5

$CeI_3$ Vapor Pressure Enhancement

Figure 4:
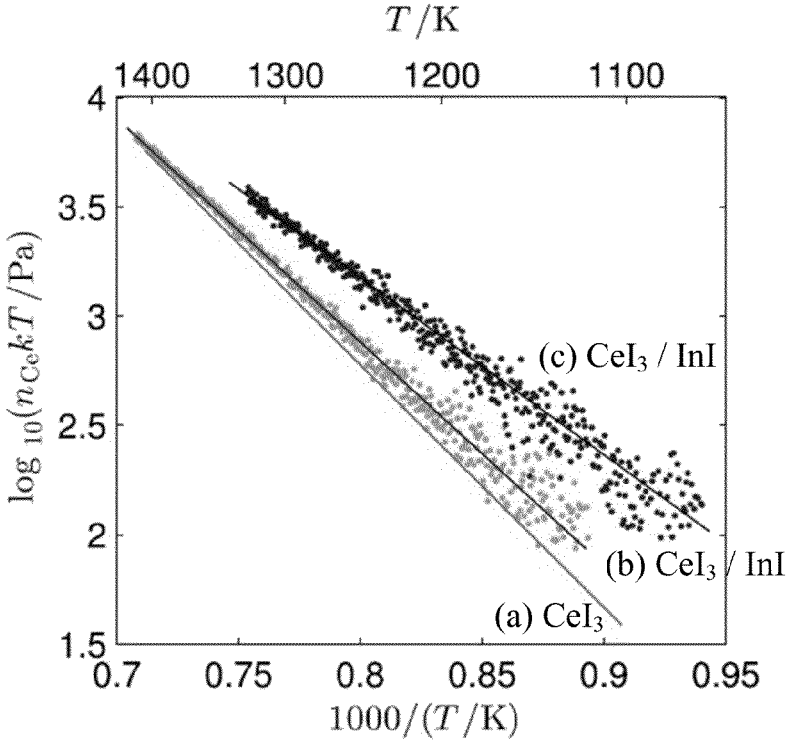
FIG. 4 shows a graph of a logarithm of vapor pressure versus temperature for an embodiment of a composition according to Example 5.

Vapor pressure of three samples were determined using X-ray fluorescence as discussed in Curry et al., J. Appl. Phys.115, 034509 (2014), the disclosure of which is incorporated herein in its entirety. The first sample (indicated as curve (a) in FIG. 4) included 10.0 milligrams (mg) $CeI_3$ and 13 kilopascals (kPa) Xe. The second sample (indicated as curve (b) in FIG. 4) included 9.58 mg $CeI_3$, 0.465 mg InI, and 13 kPa Xe. The third sample (indicated as curve (c) in FIG. 4) included 6.48 mg $CeI_3$, 3.17 mg InI, and 13 kPa Xe. FIG. 4 shows a graph of the logarithm of the vapor pressure versus temperature for the first sample (curve (a)), the second sample (curve (b)), and the third sample (curve (c)). The InI enhanced the vapor pressure of the $CeI_3$ from the lowest temperatures at least up to 1400 K.

Example 6

White Light Production

Figure 5:
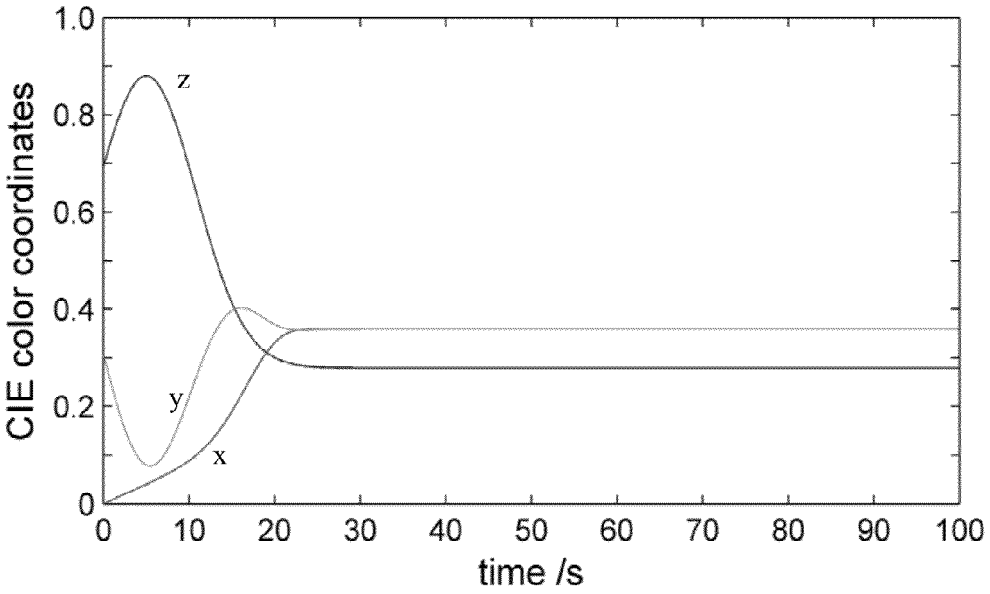
FIG. 5 shows a graph of color coordinates versus time for an embodiment of a lamp according to Example 6.

Color coordinates according to an International Commission on Illumination (CIE) 1931 XYZ color space are predicted for an exemplary composition that includes a primary halide and secondary halide for white light production. FIG. 5 shows a graph of the CIE color coordinates (x=red color coordinate; y=green color coordinate; and z=blue color coordinate) versus time for the composition. The blue component, z-coordinate is most intense at 5 seconds and decreases rapidly while the green and red components increase rapidly from initial start up until 20 seconds, corresponding to an operating period of the lamp. Here, white light is produced during the warm up period.

Example 7

Comparative Light Production

Figure 6:
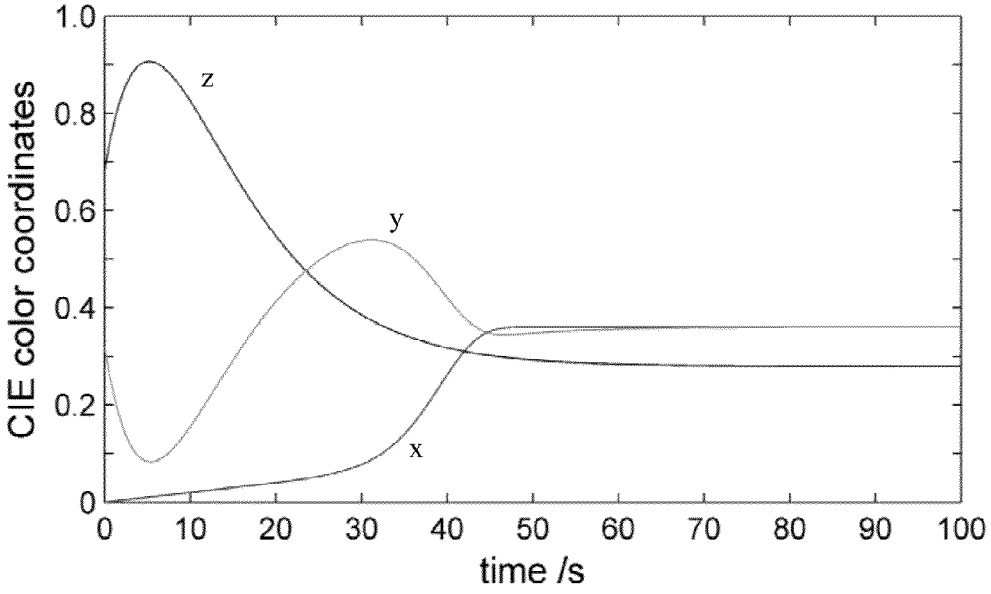
FIG. 6 shows a graph of color coordinates versus time for a comparative lamp according to Example 7.

Color coordinates according to the International Commission on Illumination (CIE) 1931 XYZ color space are predicted for a comparative composition that includes a primary halide in the absence of a secondary halide. FIG. 6 shows a graph of the CIE color coordinates (x=red color coordinate; y=green color coordinate; and z=blue color coordinate) versus time. The blue component, z-coordinate, has an intensity that persists for a protracted time through the warm up period without a rapid onset of white light production.

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A lamp comprising:

an envelope; and a composition disposed in the envelope and comprising:

an initiator;

a primary halide; and a secondary halide, wherein the primary halide, in a presence of the secondary halide, has a vapor pressure that is greater than a vapor pressure in an absence of the secondary halide, and the composition is configured to emit white light in a presence of an electrical discharge in the envelope.

2. The lamp of claim 1, wherein the composition further comprises a buffer gas.

3. The lamp of claim 1, wherein the lamp further comprises a plurality of electrodes to produce the electrical discharge.

4. The lamp of claim 1, wherein the envelope comprises a ceramic, a glass, or a combination comprising at least one of the foregoing, and the envelope has a transmittance, of the white light, from 0.5 to 0.99.

5. The lamp of claim 1, wherein the initiator comprises mercury, xenon, zinc, or a combination comprising at least one of the foregoing.

6. The lamp of claim 1, wherein the primary halide comprises a rare earth element, a transition metal, an alkali metal, an alkaline earth metal, a group 13 element, a group 14 element, a group 15 element, a group 16 element, or a combination comprising at least one of the foregoing.

7. The lamp of claim 6, wherein the secondary halide comprises:

a first element comprising:

a group 13 element, a group 14 element, a group 15 element, a group 16 element, or a combination comprising at least one of the foregoing; and a second element comprising a group 17 element.

8. The lamp of claim 7, wherein a reaction product comprising the primary halide and the secondary halide is formed in the presence of the electrical discharge.

9. The lamp of claim 1, wherein the composition further comprises a buffer gas comprising argon;

the initiator is mercury;

the primary halide comprises a rare earth metal halide; and the secondary halide comprises $GaI_3$, InI, or a combination comprising at least one of the foregoing.

10. The lamp of claim 1, wherein the composition comprises Ar, Hg, NaI, $CeI_3$, TlI, $CaI_2$, and $GaI_3$.

11. The lamp of claim 1, wherein the composition comprises InI, $GaI_3$, or a combination comprising at least one of the foregoing; Ar; Hg; NaI; $HoI_3$; $TmI_3$; $DyI_3$; TlI; and $CaI_2$.

12. The lamp of claim 1, wherein the primary halide is present in an amount from 2 wt % to 15 wt %, based on a weight of the composition.

13. The lamp of claim 1, wherein the secondary halide is present in an amount from 0.2 wt % to 1 wt %, based on a weight of the composition.

14. The lamp of claim 1, wherein the primary halide comprises a rare earth element;

the secondary halide comprises a group 13 element; and the rare earth element of the primary halide and the group 13 element of the secondary halide are present in a molar ratio from 2:1 to 20:1.

15. The lamp of claim 1, wherein the vapor pressure of the primary halide, in the presence of the secondary halide, is from 1.5 to 50 times greater than the vapor pressure of the primary halide in the absence of the secondary halide.

16. The lamp of claim 1, wherein the lamp is configured to have a warm up period less than or equal to 20 seconds.

17. The lamp of claim 16, wherein the lamp is configured such that, during a warm up period of the lamp, light emitted by the lamp has a plurality of color coordinates comprising:

x from 0.1 to 0.4;

y from 0.1 to 0.4; and z from 0.3 to 0.7, wherein:

$$x+y+z=1;$$

x is a red color coordinate;

y is a green color coordinate; and z is a blue color coordinate, based on an International Commission on Illumination (CIE) 1931 XYZ color space.

18. The lamp of claim 17, wherein the lamp is configured such that, during an operation period of the lamp, light emitted by the lamp has a plurality of color coordinates comprising:

x from 0.3 to 0.5;

y from 0.3 to 0.5; and z from 0.0.2 to 0.4, wherein:

$$x+y+z=1;$$

x is a red color coordinate;

y is a green color coordinate; and z is a blue color coordinate, based on an International Commission on Illumination (CIE) 1931 XYZ color space.

19. The lamp of claim 18, wherein the lamp is configured to have a temperature that is from 500 K to 1400 K during the warm-up period.

20. The lamp of claim 19, wherein the vapor pressure of the primary halide, in the presence of the secondary halide, is from 1.5 to 50 times greater than the vapor pressure of the primary halide in the absence of the secondary halide.

* * * * *